US006458036B1

(12) United States Patent
Gutierrez

(10) Patent No.: US 6,458,036 B1
(45) Date of Patent: Oct. 1, 2002

(54) GOLF TRAINING DEVICE

(76) Inventor: Robert Gutierrez, 3030 E. 9th St., National City, CA (US) 91950

( * ) Notice: Subject to any disclaimer, the term of this patent is extended or adjusted under 35 U.S.C. 154(b) by 0 days.

(21) Appl. No.: 09/299,474

(22) Filed: Apr. 26, 1999

(51) Int. Cl.[7] ..... A63B 69/36
(52) U.S. Cl. ..... 473/207
(58) Field of Search ..... 473/207, 214, 473/215

(56) References Cited

U.S. PATENT DOCUMENTS

| | | | | | |
|---|---|---|---|---|---|
| 2,022,910 | A | * | 12/1935 | Hanley | 473/214 |
| 2,103,502 | A | | 12/1937 | Webster | |
| 2,710,409 | A | * | 6/1955 | Burandt | 2/160 |
| 3,069,169 | A | * | 12/1962 | Topping | 473/212 |
| 3,188,090 | A | * | 6/1965 | Job | 473/214 |
| 3,804,420 | A | | 4/1974 | Boyd | |
| 4,359,221 | A | | 11/1982 | Taylor | |
| 4,895,373 | A | * | 1/1990 | Richmon | 473/215 |
| 5,188,365 | A | * | 2/1993 | Picard | 473/213 |
| 5,295,690 | A | | 3/1994 | Johnson | |
| 5,397,122 | A | * | 3/1995 | Herridge | 473/212 |
| 5,451,060 | A | | 9/1995 | Dalbo | |
| 5,665,015 | A | | 9/1997 | Clark, III | |
| 5,704,856 | A | | 1/1998 | Morse | |
| 5,718,640 | A | | 2/1998 | Noblin | |
| 6,027,413 | A | * | 2/2000 | Smith et al. | 473/215 |

* cited by examiner

*Primary Examiner*—Paul T. Sewell
*Assistant Examiner*—M. Chambers
(74) *Attorney, Agent, or Firm*—Knobbe Martens Olson & Bear LLP

(57) ABSTRACT

A golf training device, worn by golfers to improve their golf swings, is disclosed herein. The invention provides a golf training device that may include a belt and a flexible strap. The first end of the strap attaches to the belt at a position proximal to a golfer's leading hip, and the second end of the strap attaches to a distal part of the golfer's leading arm.

7 Claims, 2 Drawing Sheets

GOLF TRAINING DEVICE

BACKGROUND OF THE INVENTION

1. Field of the Invention

The present invention relates to golf training devices. More particularly, the present invention relates to training devices worn by golfers to improve their golf swings.

2. Description of the Related Art

Proficient golfers have an effective swing, which propels the ball far and straight in the desired line of flight when the club makes contact with the ball. Most people require hours of practice and patience to develop an effective golf swing. Numerous devices have attempted to help golfers improve their swing. However, these devices have been largely ineffective and overly cumbersome, and generally have not been well received. Most such devices either fail to properly coordinate different parts of the golfer's body that must work together to achieve an effective swing, or they improperly connect to too many parts of the body, creating an unnatural feel and look to both the device and the golf swing executed while using the device.

U.S. Pat. No. 2,103,502 discloses a harness including a girdle or body belt connected to a cord. The cord has means for connecting it to the neck of a golf club, but does not directly or effectively coordinate parts of the golfer's body that are critical to a good motion. U.S. Pat. No. 3,804,420 discloses a device comprising a cord reel and a length of cord that attaches to a finger-less glove worn on the hand of a golfer's leading arm. The cord reel engages the golfer's belt at the trailing hip. This device is disadvantageous because of its mechanical complexity and weight, as well as because of its undesirable coordination of leading wrist with trailing hip.

U.S. Pat. No. 5,188,365 discloses a harness that is secured to a golfer's forward knee, forward wrist, rear elbow, and waist to encourage the golfer to keep his or her limbs in correct position as the golfer proceeds through a grooved golf swing. This harness that is extremely cumbersome and creates an effect that is too complicated to effectively train a smooth, effective swing. U.S. Pat. No. 5,295,690 discloses a device including two interconnected elastic arm cuffs which each fit on one of the golfer's arms between the elbow and shoulder such that the golfer's arms are biased toward each other while executing a golf swing. An elastic hip strap is connected to the arm cuff holding the trailing swing arm and is secured to the golfer's leading hip. This device is disadvantageously cumbersome and can be uncomfortable in use.

U.S. Pat. No. 5,451,060 discloses a stroke enhancing harness. The harness includes a loop of elastic material, which extends around the shoulder of a trainee. A strap of inelastic material snaps over the back and under the trainee's other shoulder. The inelastic material of the strap provides a total restraint of the swing, to restrict the tendency of a trainee to extend beyond a point of swinging efficiency. However, this device does not coordinate motion of the upper and lower body. Likewise, U.S. Pat. No. 5,665,015 discloses an apparatus having a chest loop, a biceps loop, and a forearm loop. During a golf swing, the biceps loop and the forearm loop restrain the elbow of the golfer's leading arm from detaching during the follow through portion of the swing. The device fails to aid in development of proper backswing motion, and also fails to coordinate motion of the arms and hips.

U.S. Pat. No. 5,718,640 discloses a device including a belt structure, a strap member fitted around the user's trailing arm near the elbow, and a coupling structure designed to restrict generally upward movement of the strap member yet permit sliding motion of the strap member along the belt structure. This device does not coordinate motion of the leading arm and the leading hip, and may be cumbersome in appearance and feel.

Thus, there is a need for an improved training device that properly coordinates movement of key parts of the golfer's body to instruct an effective golf swing, without being unduly cumbersome or conspicuous in use.

SUMMARY OF THE INVENTION

The present invention provides a golf training device that may include a belt adapted to be worn around a waist of a golfer, and a flexible strap having a first end and a second end. The first end of the strap may be attached to the belt at a position on the belt proximal to a leading hip of the golfer, and the second end of the strap may be adapted to attach to a distal part of a leading arm of the golfer. This device does not attach to another arm or a leg of the golfer.

The flexible strap may include an elastic material. The second end of the strap may be adapted to attach to a wrist or a hand of the leading arm of the golfer. For example, the second end of the strap may be attached to a glove. The second end of the strap may be attached to the glove by stitching, or it may be detachably attached to the glove, such as by a deformable coupling device. Likewise, the strap may be attached to the glove by a hook and loop fastener. In another embodiment, the second end of the strap may be attached to a wristband.

In accordance with the invention, the belt and/or the strap may be adjustable in length. The first end of the strap may be attached to the belt by stitching, or it may be detachably attached to the belt such as, for example, by a deformable coupling device or a hook and loop fastener.

In another embodiment, the golf training device is a flexible strap having a first end and a second end, wherein the first end of the strap is adapted to attach to a garment worn by a golfer at a position on the garment proximal to a leading hip of the golfer, and the second end of the strap is adapted to attach to a distal part of a leading arm of the golfer, wherein the device does not attach to another arm or a leg of the golfer. The garment mentioned in this embodiment may be a belt. The flexible strap may include an elastic material. The second end of the strap may be adapted to attach to a wrist or a hand of the leading arm of the golfer. For example, the second end of the strap may be attached to a glove.

DETAILED DESCRIPTION OF THE PREFERRED EMBODIMENT

Figure 1:
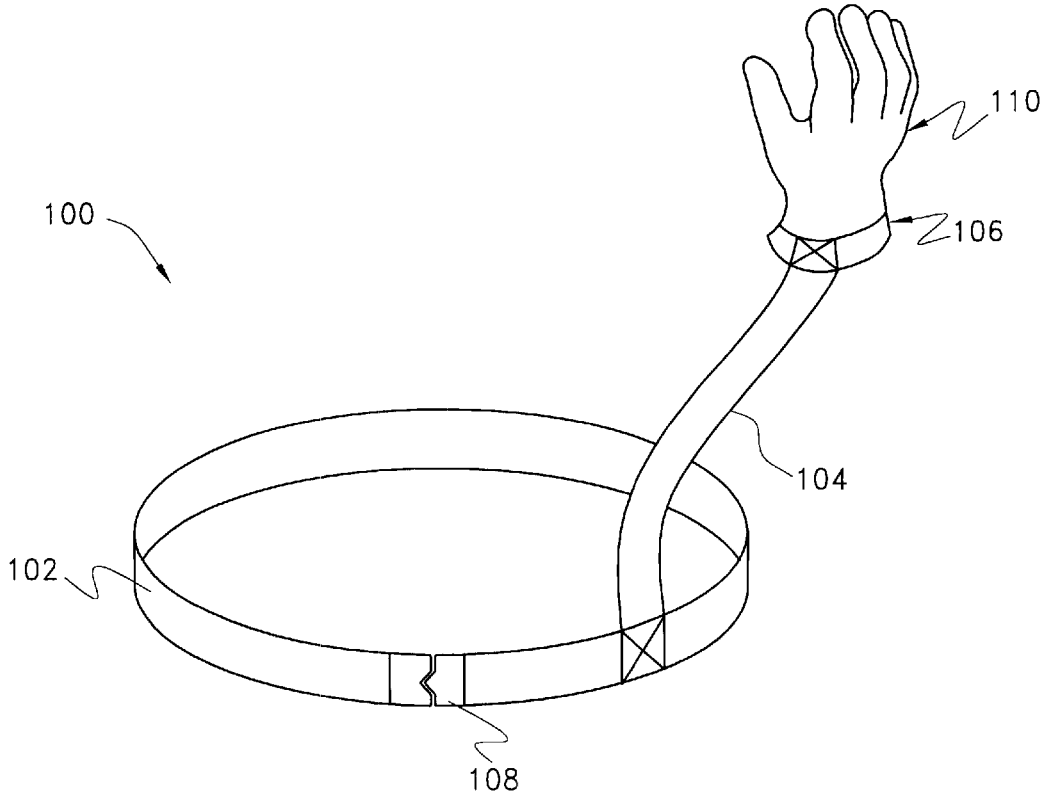
FIG. 1 illustrates one embodiment of the golf training device.

FIG. 1 illustrates one embodiment of a golf training device 100 including a belt 102 and a strap 104 and optionally including a band 106 and a glove 110. In the illustrated embodiment, the belt 102 comprises any suitable flexible material, such as, for example, webbing, leather, canvas, elastic, plastic, and the like. The belt 102 includes a fastening member 108, which comprises any suitable fastener such as, for example, a deformable coupling device or a hook and loop fastener (such as VELCRO®). The fastening member 108 is used to secure the belt 102 around the waist of a golfer.

The strap 104 comprises any suitable flexible, elastic material. A first end of the strap 104 is attached to the belt 102, and a second end of the strap 104 is adapted to attach to a golfer's arm at a distal part, such as the forearm, wrist, or hand. The strap 104 may be so adapted by use of a band 106, a glove, 110, or both. The first end of the strap 104 may be attached to the belt 102 using any suitable fastening means. For example, in the illustrated embodiment, the first end of the strap 104 is attached to the belt 102 by sewing the first end of the strap 104 to the belt 102. In other embodiments, the first end of the strap 104 may be detachably attached to the belt 102 with, for example, a deformable coupling device, a hook and loop fastener, buttons, snaps, or zippers.

As illustrated in FIG. 1, the golf training device may optionally include a band 106. The band 106 may be attached to the second end of strap 104 using any suitable fastening means. For example, in the illustrated embodiment, the band 106 is attached to the second end of the strap 104 by sewing the second end of the strap 104 to the band 106. In other embodiments, the band 106 may be detachably attached to the second end of the strap 104 with a deformable coupling device, such as, for example, a hook and loop fastener, snaps, zippers, or buttons.

The band 106 of the illustrated embodiment comprises any suitable flexible material, such as, for example, webbing, leather, canvas, elastic, plastic, and the like. The band 106 may be fastened around a golfer's arm at a distal part, such as the forearm, wrist, or hand. The band 106 may be fastened using any suitable fastener, such as a deformable coupling device, snaps, zippers, a hook and loop fastener, buttons, or the like.

As illustrated in FIG. 1, the golf training device 100 may optionally include a glove 110 attached to the second end of the strap 104 or to the band 106. The glove 110 may be attached to the second end of strap 104 or to the band 106 using any suitable fastening means. For example, in the illustrated embodiment, the glove 110 may be attached to the band 106 by sewing the glove 110 to the band 106. In other embodiments, the glove 110 may be detachably attached to the second end of the strap 104 or to the band 106 with any other fastening device known in the art, nonlimiting examples of which are provided above in reference to other parts of the invention.

Figure 2:
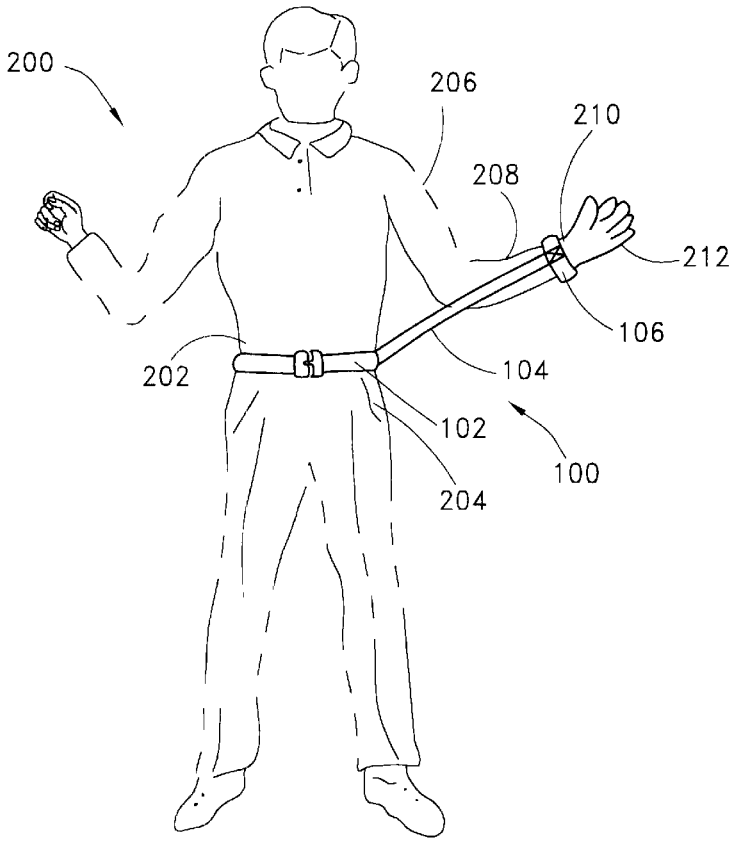
FIG. 2 illustrates a front view of a golfer wearing one embodiment of the golf training device.

FIG. 2 illustrates a front view of a golfer 200 wearing one embodiment of the golf training device 100. The golfer 200 has a waist 202, a leading hip 204, and a leading arm 206. The leading arm 206 includes a forearm 208, a wrist 210, and a hand 212. As used herein, a "leading" side of the golfer 200 is the side of the golfer 200 facing the target when the golfer 200 swings a club. For example, the golfer 200 as illustrated in FIG. 2 has a right-hand swing. Accordingly, the left side of the golfer 200 faces the target when the golfer 200 swings a club and is, therefore, the leading side of the golfer 200. Although the device 100 as illustrated in FIG. 2 is configured for a golfer 200 with a right-hand swing, the device 100 can be modified to accommodate a golfer 200 with a left-hand swing by attaching the band 106 to the other arm of the golfer 200 and reversing the orientation of the belt 102.

The golfer 200 wears the belt 102 with the strap 104 attached to the belt 102 at a position proximal to the leading hip 204 of the golfer 200. The golfer 200 can adjust the length of the belt 102 so that it fits securely and comfortably around the waist 202 of the golfer 200. The golfer 200 as shown in FIG. 2 wears the band 106 around a wrist 206 of the leading arm 204 of the golfer 200. The golfer 200 may also wear the band 106 around a forearm 208 or hand 210 of the leading arm 204 of the golfer 200. Using other embodiments of the golf training device 100, the golfer 200 may wear a glove 110 on the hand 210 of the leading arm 204 of the golfer 200. The golfer 200 can adjust the length of the band 106 so that it fits securely and comfortably around the wrist 206 of the golfer 200. The golfer 200 can also adjust the length of the strap 104 so that the strap 104 is taut but not stretched when the golfer 200 stands at rest.

In another embodiment, the golf training device 100 is a flexible strap 104 adapted to be attached to an existing garment worn by a golfer. The properties of the strap 104, and the alternative ways in which the strap 104 may attach to the leading arm of the golfer, such as, for example, using a band 106 and/or a glove 110 are as described above in reference to the other embodiments of the invention. In this embodiment, however, the flexible strap 104 attaches to a belt, pants, shirt, jumpsuit, or any other garment worn by the golfer proximal to the golfer's leading hip. The device of this aspect of the invention thus coordinates motion of the leading arm and the hips of the golfer as described below.

Figure 3:
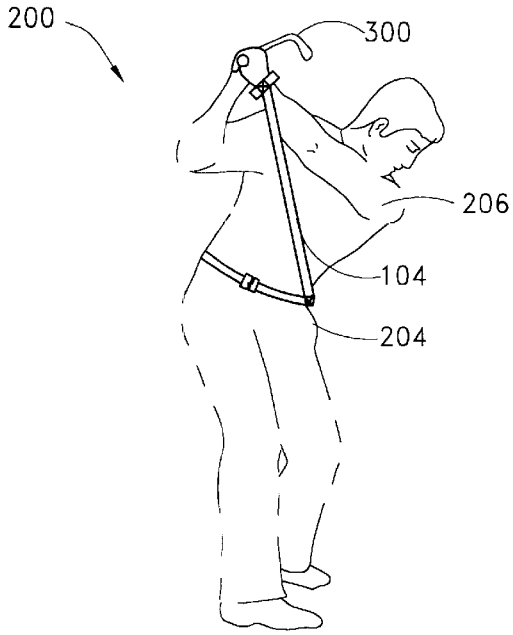
FIG. 3 illustrates a side view of a golfer wearing one embodiment of the golf training device at the top of the backswing.

FIG. 3 illustrates a side view of a golfer 200 wearing one embodiment of the golf training device 100 at an apex of a backswing. As the golfer 200 raises a club 300 during the backswing, the elasticity of the strap 104 creates increasing tension against the motion of the leading arm 206 of the golfer 200 and against the lack of motion of the leading hip 204 of the golfer 200. By increasing the tension against the motion of the leading arm 206 of the golfer 200, the strap 104 encourages the leading arm 206 of the golfer 200 to remain straight during all or most of the backswing. By increasing the tension against the lack of motion of the leading hip 204 of the golfer 200, the strap 104 also encourages the leading hip 204 of the golfer 200 to rotate during the backswing. By encouraging the leading arm 206 of the golfer 200 to remain straight and the leading hip 204 of the golfer 200 to rotate, the golf training device 100 helps improve the backswing of the golfer 200, which helps the golfer 200 develop an effective swing.

During the forward swing, the device 100 encourages the golfer 200 to resist the elastic pull on the leading hand by keeping the leading arm 206 straight. Also, because of the rotation of the leading hip 204 during the backswing, the counter-rotation of the leading hip 204 during the foreswing adds power to the stroke. Thus, the training device 100 of the invention coordinates the critical motions of the upper and lower body through both the backswing and the foreswing in a very simple, yet effective way.

The golf training device 100 demonstrates significant advantages over other golf swing training devices. For example, unlike other devices, the golf training device 100 coordinates the motion of the leading arm 206 and the leading hip 204 of a golfer 200 during both the backswing and the foreswing. By affecting the motion of both the leading arm 206 and the leading hip 204 of a golfer 200 during a backswing, the golf training device 100 helps the golfer 200 develop an effective swing quickly.

Another advantage of the golf training device is that it promotes efficiency. For example, typical golf swing training devices are complex because they have many components. Due to their complexity, typical golf swing training devices require golfers to spend a substantial amount of time learning how to wear and use the devices. In addition, every time a golfer uses a typical golf swing training device, the golfer must take a substantial amount of time to put on and remove the device. The golf training device of the invention, on the other hand, has few components and a straightforward design. Therefore, golfers can quickly learn how to wear and use the golf training device and can efficiently put on and remove the device.

Yet another advantage of the device of the invention is its aesthetic appeal. As discussed above, typical golf swing training devices have more components than the device of the invention. Because they have many components, typical golf swing training devices are bulky, conspicuous, and unattractive. By contrast, the golf training device of the invention has a simple, unobtrusive appearance because it has relatively few components.

Although the foregoing invention has been described in terms of certain preferred embodiments, other embodiments will become apparent to those of ordinary skill in the art in view of the disclosure herein. Accordingly, the present invention is not intended to be limited by the recitation of preferred embodiments, but is intended to be defined solely by reference to the appended claims.

What is claimed is:

1. A method of controlling a golfer's swing, wherein the golfer's swing includes a backswing, comprising:

fitting a device around a golfer's waist, wherein the device comprises a point of attachment proximal to a leading hip of the golfer, wherein the device attaches, at the point of attachment, to a flexible strap, the flexible strap having a first end and a second end, and wherein the device does not have an additional strap attaching to another arm or leg of the golfer; and attaching the second end of the flexible strap to a distal part of a leading arm of the golfer, wherein the flexible strap increases tension against a motion of the leading arm of the golfer during the backswing so as to encourage the leading arm to remain substantially straight during a majority of the backswing.

2. The method of claim 1, wherein the flexible strap is detachably attached at the point of attachment.

3. The method of claim 1, wherein the flexible strap is permanently attached to the device.

4. The method of claim 1, wherein the distal part comprises a wrist of the leading am of the golfer.

5. The method of claim 1, wherein the distal part comprises a hand of the leading arm of the golfer.

6. The method of claim 1, wherein the second end of the flexible strap attaches to a glove worn on a hand of the leading arm of the golfer.

7. A method of coordinating the motion of a golfer's leading arm during a golf swing comprising encouraging the golfer's leading arm to remain substantially straight during the majority of a backswing portion of the golf swing by attaching a first end of a flexible strap to a distal part of the leading arm and a second end of the flexible strap proximal to a leading hip of the golfer, wherein no additional straps are attached to the golfer.

* * * * *